United States Patent [19]

Mancel

[11] Patent Number: 5,065,935

[45] Date of Patent: Nov. 19, 1991

[54] NO WRAP BOXES

[75] Inventor: James D. Mancel, Aurora, Canada

[73] Assignee: Shorewood Technologies, Inc., Dover, Del.

[21] Appl. No.: 538,679

[22] Filed: Jun. 14, 1990

Related U.S. Application Data

[63] Continuation of Ser. No. 268,580, Nov. 8, 1988, abandoned.

[51] Int. Cl.[5] ..... B65D 5/26

[52] U.S. Cl. ..... 229/40; 229/136; 229/143; 229/194; 229/922

[58] Field of Search ..... 229/40, 922, 923, 136, 229/143, 194

[56] References Cited

U.S. PATENT DOCUMENTS

| | | | |
|---|---|---|---|
| 1,591,061 | 7/1926 | Smith . | |
| 1,616,014 | 2/1927 | Walter | 229/143 |
| 1,726,108 | 8/1929 | Hughes | 229/143 |
| 1,871,888 | 8/1932 | Johnson | 229/923 |
| 1,894,226 | 1/1933 | Ross | 229/194 |
| 1,919,789 | 7/1933 | Knowlton . | |
| 2,095,764 | 10/1937 | Roeckert | 229/143 |
| 2,148,021 | 3/1939 | Greve | 229/194 X |
| 2,189,055 | 3/1940 | Cage | 229/194 X |
| 2,479,456 | 8/1949 | Arthur | 229/87 R |
| 2,646,914 | 7/1953 | Claff . | |
| 2,741,415 | 4/1956 | Meitzen | 229/194 X |
| 2,769,588 | 11/1956 | Beck . | |
| 2,932,439 | 4/1960 | Sparling | 229/923 |
| 3,009,624 | 11/1961 | Knox | 229/194 |
| 3,311,289 | 3/1967 | French | 229/87 R |
| 3,381,889 | 5/1968 | Laskow | 229/87 R |
| 3,391,856 | 7/1968 | Siegler | 229/138 X |
| 3,394,867 | 7/1968 | Gregg . | |
| 3,415,358 | 12/1968 | Faller | 229/143 |
| 3,451,611 | 6/1969 | Adams | 229/923 X |
| 3,459,358 | 8/1969 | Adams . | |
| 3,460,738 | 8/1969 | Adams et al. . | |
| 3,499,598 | 3/1970 | Foley et al. . | |
| 3,521,811 | 7/1970 | De Paul et al. . | |
| 3,790,064 | 2/1974 | Kramer | 229/923 |
| 3,790,069 | 2/1974 | Straccamore | 229/923 |
| 3,829,005 | 10/1974 | Hackenburg et al. | 229/923 |
| 3,851,815 | 12/1974 | Desmond et al. | 229/923 |
| 3,942,711 | 3/1976 | Desmond et al. | 229/87 R |
| 3,973,723 | 8/1976 | Owens | 229/143 |
| 4,005,814 | 3/1977 | Foster | 229/923 X |
| 4,228,947 | 10/1980 | Eroyan | 229/87 R |
| 4,239,148 | 12/1980 | Sorenson et al. | 229/194 X |
| 4,679,725 | 7/1987 | Wilson | 229/194 |
| 4,858,822 | 8/1989 | Johnson et al. | 229/922 |

FOREIGN PATENT DOCUMENTS

| | | | |
|---|---|---|---|
| 0270495 | 7/1968 | Austria | 229/87 R |
| 0996079 | 8/1976 | Canada | 229/87 R |
| 0108537 | 5/1984 | European Pat. Off. | 229/87 R |
| 0470937 | 8/1937 | United Kingdom | 229/143 |
| 0536719 | 5/1941 | United Kingdom | 229/143 |
| 1035573 | 7/1966 | United Kingdom | 229/143 |

*Primary Examiner*—Gary E. Elkins

*Attorney, Agent, or Firm*—Darby & Darby

[57] ABSTRACT

A decorative box is disclosed for gift wrapping that requires no additional wrapping paper. The box is made from a blank that has a central panel with opposed end flaps. Side panels fold up perpendicular to the central panel and have interlocking end portions that fit inside the end flaps. Outer panels attached to the side panels fold over the close the box. The outer panels have distal flaps that tuck in behind the end flaps. Wrapping paper can be applied to the outer surface of the box and adhered to the inner surface of the box blank around the periphery thereof to make a pre-wrapped gift box.

24 Claims, 5 Drawing Sheets

NO WRAP BOXES

This is a continuation of application Ser. No. 268,580, filed Nov. 8, 1988, now abandoned.

BACKGROUND OF THE INVENTION

This invention relates to decorative gift boxes that require no additional wrapping paper, and in particular, to pre-wrapped gift boxes. In the past, many types of boxes or cartons have been made wherein the boxes are stamped out of a sheet of flat material, such as cardboard, to form a blank. The boxes are then creased or scored at appropriate locations and shipped to the end user, where the user folds the blank into the desired carton shape. The boxes can be coloured or printed, but normally they have to be covered with wrapping paper to make them sufficiently attractive to be used for enclosing gifts.

In order to overcome the need to gift wrap a box or carton, attempts have been made to apply wrapping paper directly to the box blank, so that when the blank is folded into the desired box shape, the box is automatically wrapped with the wrapping paper. An example of such a structure is shown in U.S. Pat. No. 2,479,456 issued to W. H. Arthur. A difficulty with this structure, and in fact most prior art structures of this type, is that they are very fragile and difficult to package and ship without damage. Further, the assembly of these prior art structures still requires a great deal of skill or manual dexterity, with the result that the desired end effect of a pleasing and skillfully wrapped gift is often not achieved.

The present invention provides a box that is sturdy, that can be folded into a flat and compact configuration to facilitate shipping and point of sale marketing without damage, and which easily folds into an attractive and professional looking gift box, with or without pre-wrapping applied to it.

SUMMARY OF THE INVENTION

According to one aspect of the invention, there is provided a box blank comprising a central panel having a center portion and opposed end flaps joined thereto along respective first crease lines. Opposed side panels are joined to the central panel along respective second crease lines located perpendicularly to the first crease lines, each side panel having an inner portion and opposed end portions joined to the inner portion along extensions of the first crease lines. The end portions have transverse slots for interlocking engagement with a respective adjacent end portion when the side panels are folded perpendicularly to the central panel. Also, opposed outer panels are joined to the side panels along respective crease lines located parallel to the second crease lines, each outer panel having a mid portion and opposed distal flaps joined to the mid portion along extensions of the first crease lines.

According to another aspect of the invention there is provided a box comprising a central panel having a center portion and opposed perpendicular end flaps. Opposed side panels are joined to the center portion and disposed perpendicularly to the center portion, the side panels having inner portions extending between the end flaps and interlocking end portions located inside the end flaps. Also opposed outer panels are joined to the side panels and have mid-portions overlying the center portion to close the box. The outer panels further have opposed perpendicular distal flaps located beside the respective end flaps.

Preferred embodiments of the invention will now be described, by way of example, with reference to the accompanying drawings.

DETAILED DESCRIPTION OF THE PREFERRED EMBODIMENTS

Figure 1:
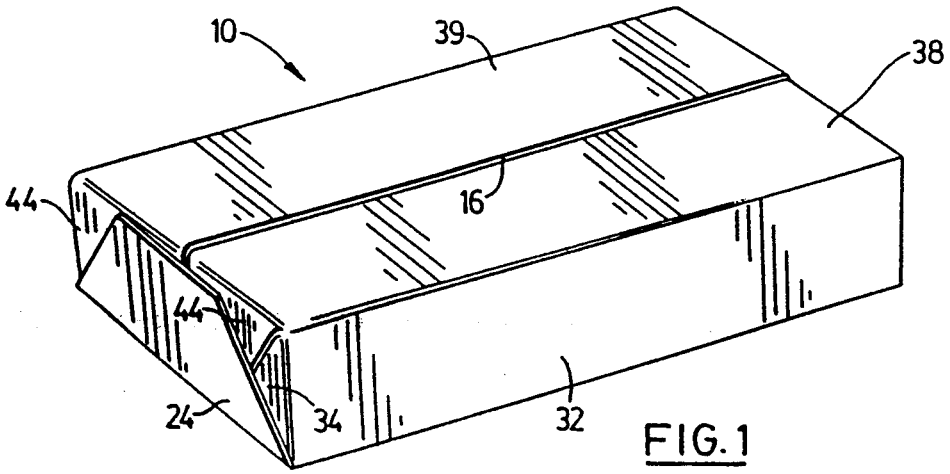
FIG. 1 is a perspective view of a preferred embodiment of a box according to the present invention turned upside down for the purposes of illustration.

Referring to the drawings, a preferred embodiment of a decorative or no-wrap box according to the present invention is generally indicated by reference numeral 10. Box 10 is made from a plain blank 12 (FIG. 3) or a pre-wrapped blank 14 (FIG. 8), and in either case, the appearance of the box made from these blanks is of the same shape as shown in FIG. 1. It will be noted that box 10 as shown in FIG. 1 is upside down. In use, the box normally would be turned over so that it has a flat smooth top surface and seam 16 shown in FIG. 1 would be on the bottom.

Figure 2:
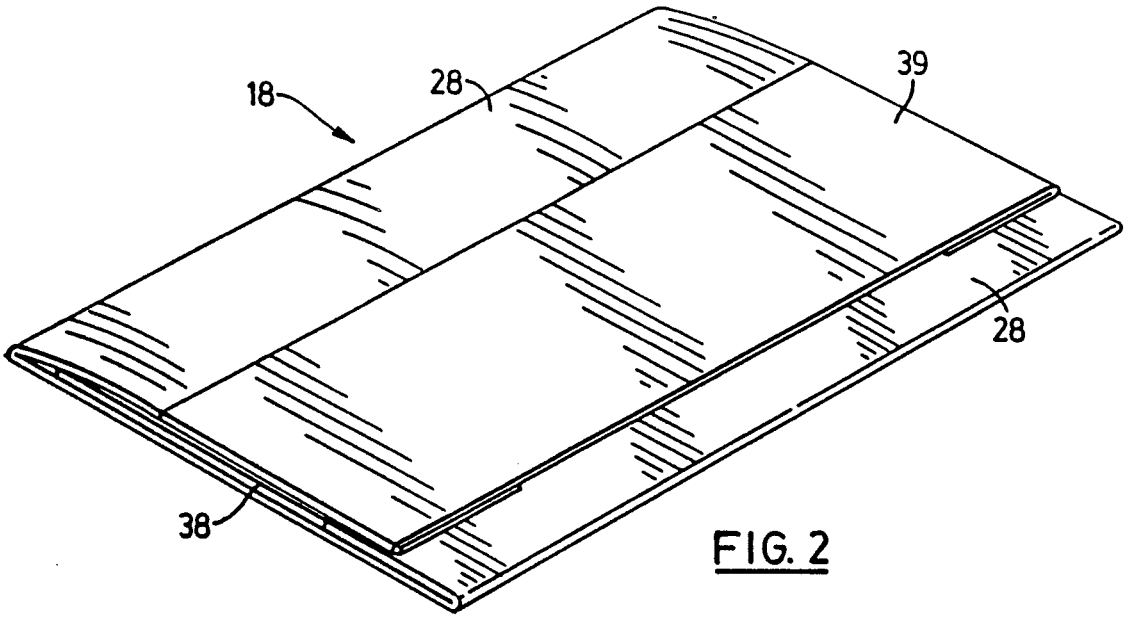
FIG. 2 is an enlarged perspective view of the box of FIG. 1 folded flat ready to be packaged for sale.

FIG. 2 is a slightly enlarged view of box 10 folded flat into a shipping or point of sale flat configuration 18, where it can be shrink wrapped or enclosed in a suitable bag or other type of wrapping for convenient display and sale without damage.

Figure 3:
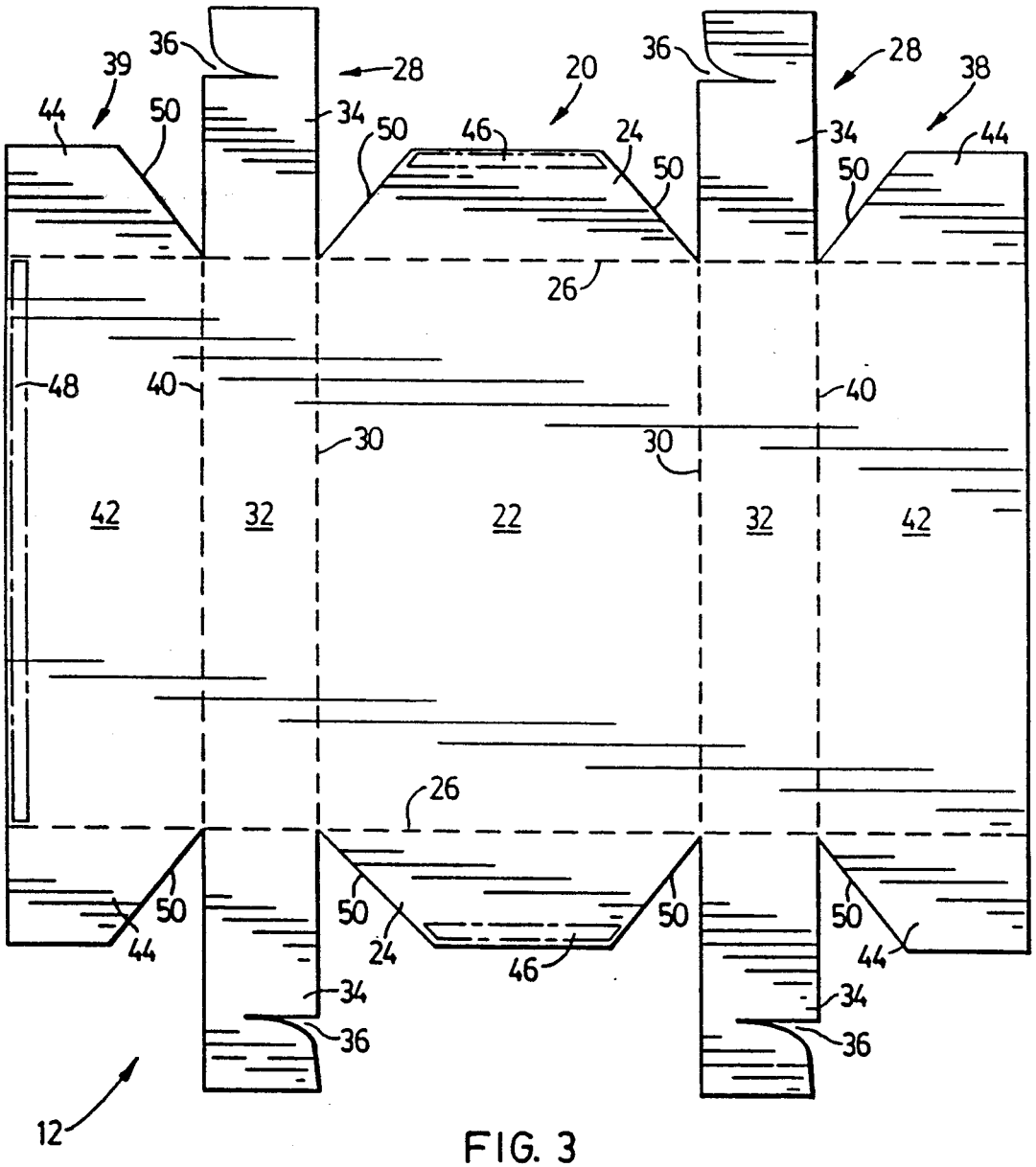
FIG. 3 is a plan view of a blank used to make the box shown in FIG. 1.

Referring now to FIG. 3 the box blank 12 is shown having a central panel 20 which includes a center portion 22 and opposed end flaps 24 joined thereto along respective dotted crease lines 26. It will be appreciated that crease lines 26 could either be embossed or crimped lines or they could be score lines as is common in this type of box or carton construction, and for the purposes of this disclosure, the term "crease lines" is intended to include all configurations intended as fold lines or to faciliate the folding of one portion of the blank about another.

Blank 12 is formed from a suitable cardboard or card stock material as is commonly used in gift boxes, but it will be appreciated that other materials could be used as well, such as plastics. It will also be appreciated that one surface of blank 12 becomes the outside surface of box 10, and the opposite surface of blank 12 becomes the inside surface of box 10. Normally, only the outside surface of box 10 would be colored or printed decoratively.

Blank 12 also includes opposed side panels 28 which are joined to central panel 20 along respective second dotted crease lines 30 located perpendicularly to first crease lines 26. Each side panel 28 has an inner portion 32 and opposed end portions 34 joined to inner portions 32 along extensions of first crease lines 26. End portions 34 have transverse slots 36 for interlocking engagement with a transverse slot on a respective adjacent end portion 34 when side panels 28 are folded perpendicularly to central panel 20, as will be described further below.

Blank 12 also has opposed outer panels 38,39 joined to side panels 28 along respective third dotted crease lines 40 located parallel to second crease lines 30. Each outer panel 38,39 has a mid-portion 42 and opposed distal flaps 44 joined to mid-portion 42 along extensions of first crease lines 26.

Optional self-adhesive strips 46,48 are applied to the inside surface of blank 10 adjacent respectively to the outermost peripheral edge of each end flap 24 and the mid-portion of outer panel 39. Preferably, self-adhesive strips 46,48 are of the type that are pressure sensitive and also not permanent, so that the respective end flaps 24 and outer panel 39 can be releaseably attached to the mating or adjacent portions of blank 12 when the box is assembled, so that box 10 can be disassembled or unfolded for flat storage and repeated use.

The width of outer panel 39 is approximately one-half the width of central panel 20, and the width of outer panel 38 is greater than one-half the width of central panel 20, preferably by about one centimetre, so that outer panel 39 rests on top of and overlaps outer panel 38 when box 10 is assembled but seam 16 (FIG. 1) remains about in the center of box 10. Alternatively, both of the outer panels 38,39 could be slightly wider than one-half the width of central panel 20, so that it would not matter which outer panel overlapped the other. The result would be that seam 16 would be slightly off center, but this would not materially detract from the appearance of box 10.

In the preferred embodiment, the width of end flaps 24 is equal to the width of both the inner portions 32 and end portions 34 of side panels 28, and also equal to the width of distal flaps 44. The term "width" is intended to mean the horizontal or left to right dimensions of central panel 20, side panels 28, side panel inner and end portions, 32 and 34, and outer panels 38,39 as viewed in FIG. 3, and the term "width" in reference to end flaps 24 and distal flaps 44 is intended to mean the vertical or top-to-bottom dimensions of these flaps as viewed in FIG. 3. Further, the term "equal" when referring to the width of the various portions of blank 12 is intended for the purposes of this disclosure to mean approximately equal or within the thickness of the material used for blank 12. As will be apparent from the discussion of the assembly of box 10, the end flaps 24, end portions 34 and distal flaps 44 overlap upon assembly of the box, and it may be desirable to alter the width of these elements slightly depending upon the width of the material used for blank 12 to give the best appearance, as will be apparent to those skilled in the art.

End flaps 24 and distal flaps 44 have side edges 50 adjacent to side panels 28 that intersect side panels 28 at acute angles. These angles are preferably about 30 degrees, but they could be larger, such as 45 degrees if desired. Preferably, all of these angles are equal, to give the most pleasing appearance to the ends of box 10.

Referring to FIGS. 2 and 3, it will be appreciated that the configuration shown in FIG. 2 is obtained by folding the end flaps 24, end portions 34 and distal flaps 44 inwardly along crease lines 26. Side panel 28 and outer panel 38 are then folded inwardly along the respective crease line 30, and side panel 28 and outer panel 39 are then folded inwardly along their respective crease line 30.

Figure 4:
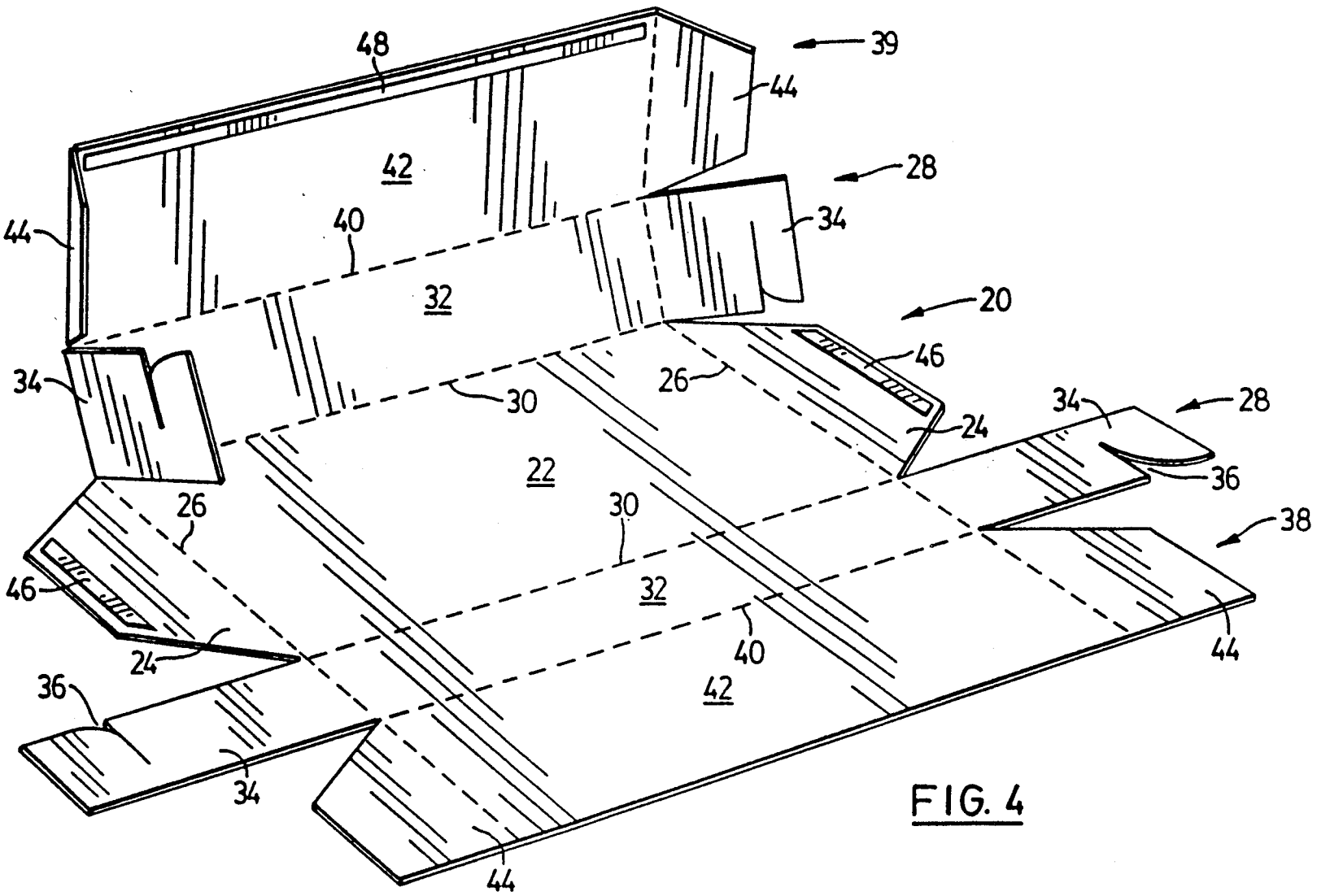
FIGS. 4 to 7 show the sequence of steps involved in the assembly of the box shown in FIG. 1.
Figure 5:
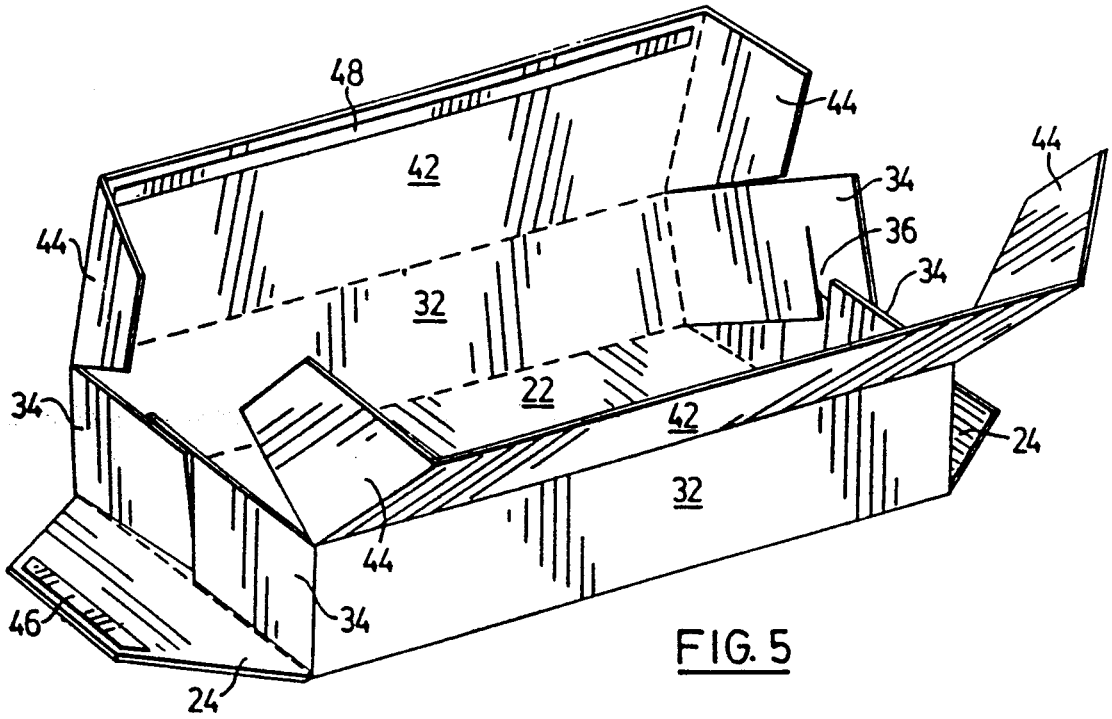

Referring next to FIGS. 4 through 7, the assembly of box 10 will now be described. First, as shown in FIG. 4, one of the side panels 28 is folded upwardly and inwardly and its respective end portions 34 are folded inwardly. The other side panel 28 is then folded upwardly and inwardly as seen in FIG. 5 and the respective end portions 34 are then interlocked by mating the respective transverse slots 36. Transverse slots 36 are spaced from first crease lines 26 a distance equal to one-half the width of central panel 20 and this makes side panels 28 perpendicular to center portion 22 of central panel 20.

Figure 6:
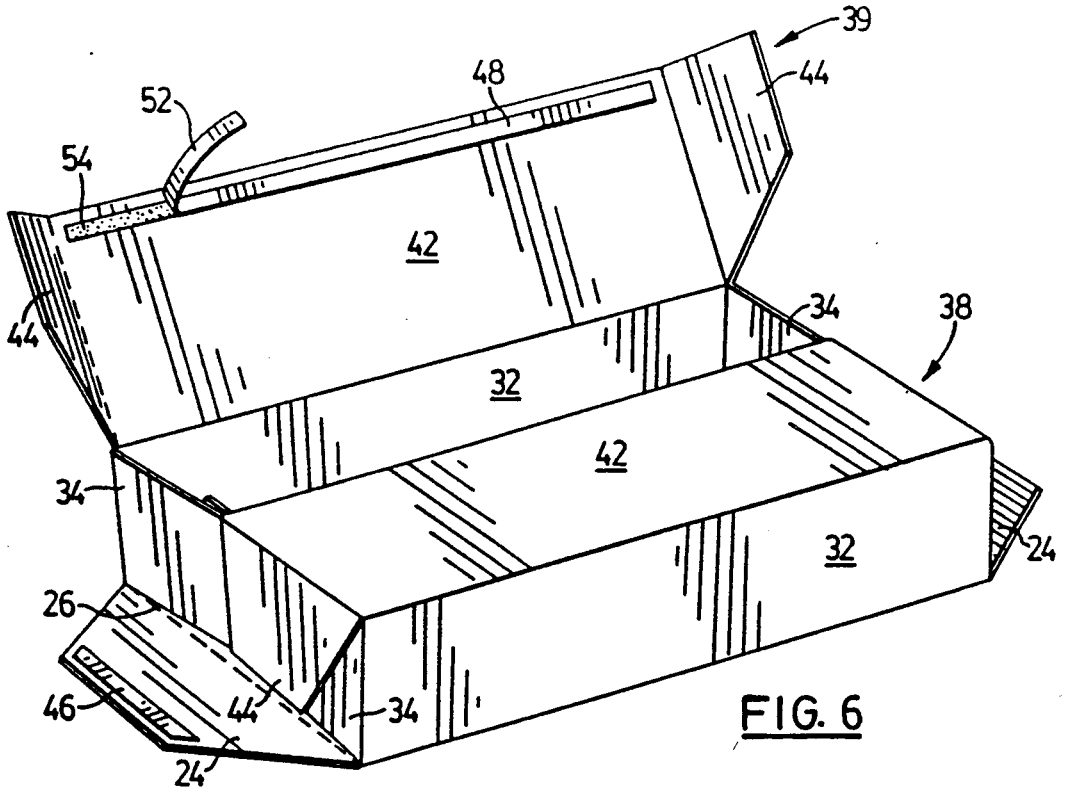
Figure 7:
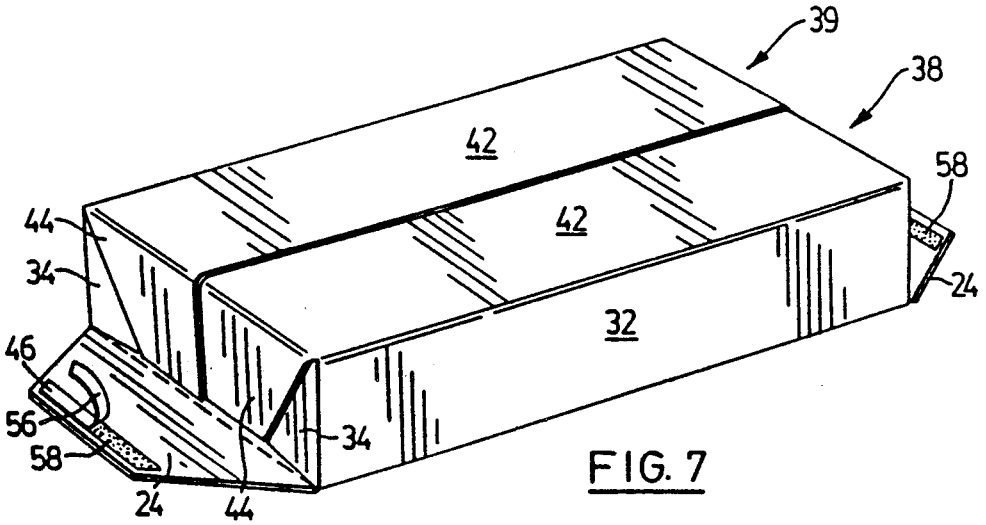

Outer panel 38 is then folded inwardly and downwardly as are its respective distal flaps 44 as seen in FIG. 6. This causes mid-portion 42 of outer panel 38 to overlie central panel 20 and close approximately one-half of box 10. Outer panel 39 is then folded inwardly and downwardly as well as its respective distal flaps 44 to complete the closure of box 10 as seen in FIG. 7. Prior to completing this step, a protective strip 52 (FIG. 6) is removed from the self-adhesive strip 48 to expose the adhesive 54, thus causing outer panel 39 to adhere to outer panel 38.

Finally, end flaps 24 are folded upwardly and inwardly to contact distal flaps 44. Prior to this step, however, protective strips 56 (FIG. 7) are removed from self-adhesive strips 46 to expose adhesive 58 and thus cause end flaps 24 to adhere to distal flaps 44. This completes the box to the configuration shown in FIG. 1.

Figure 8:
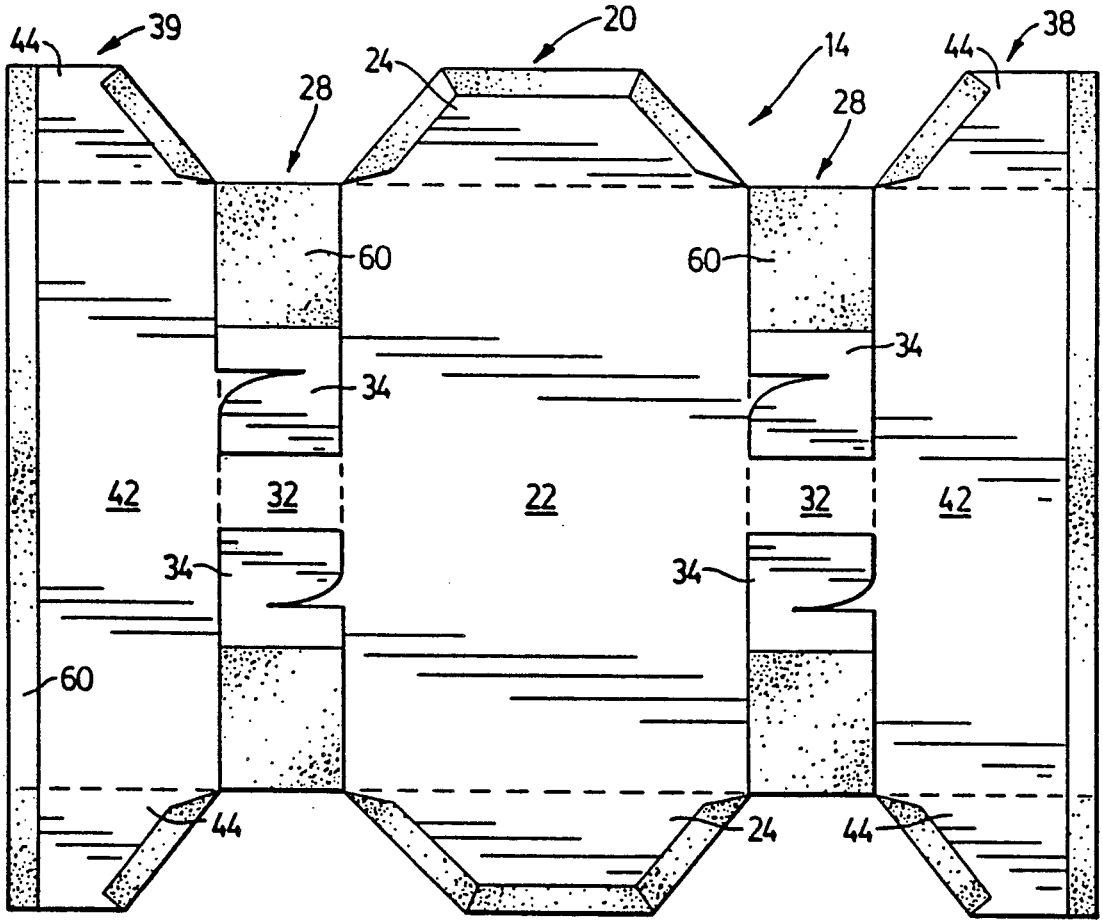
FIG. 8 is a plan view of another embodiment of the invention wherein the blank is pre-wrapped with wrapping paper.

Referring next to FIG. 8, pre-wrapped blank 14 is shown having a layer of wrapping paper 60 applied to the outer surface of this blank. The wrapping paper is wrapped around the peripheral edges of blank 14, and only these wrapped around peripheral edges are adhesively attached to the inside surface of blank 14. In FIG. 8, end portions 34 have been folded inwardly to show the limit of coverage of wrapping paper 60. It will be appreciated that by folding over and adhesively attaching the edges of wrapping paper 60 in the manner shown in FIG. 8, no loose edges or surfaces of the wrapping paper are left exposed to be damaged prior to assembly of the box. Also, the embodiment of FIG. 8 can be folded so that it has the configuration of FIG. 2.

Having described perferred embodiments, it will be appreciated that various modifications may be made to the structures described. For example, the overall shape of box 10 can be changed so that it has any length, width and height dimensions desired. As mentioned above, the shapes of end flaps 24 and distal flaps 44 can be modified to change the appearance of the ends of box 10. For example, end flaps 24 could be rectangular in shape in which case they would cover the full box ends. Distal flaps 44 could be located outside of end flaps 24, and distal flaps 44 could also be rectangular in shape if desired.

From the above, it will be appreciated that a very simple and easily assembled decorative or no-wrap gift box is provided by this invention that can be attractively packaged for point of sale appeal with little chance of the box or the blanks being damaged prior to use.

I claim:

1. A box blank comprising:

a central panel having a center portion and opposed end flaps joined thereto along respective first crease lines;

opposed side panels joined to said central panel along respective second crease lines located perpendicularly to the first crease lines, each side panel having an inner portion and opposed end portions joined to the inner portion along extensions of said first crease lines, said end portions having means for interlocking engagement with a respective adjacent said end portion when the side panels are folded perpendicularly to the central panel;

opposed outer panels joined to the side panels along respective crease lines located parallel to the second crease lines, each outer panel having a mid-portion and opposed distal flaps joined to the said mid-portion along extensions of the first crease lines, the width of said outer panels combined being greater than the width of the central panel, and the width of said end flaps being equal to the width of said distal flaps;

wherein the box blank has peripheral edges and inner and outer surfaces, and further comprises a layer of wrapping paper located over said outer surface and wrapped around the peripheral edges of the box blank so as to conform to the shape thereof, the peripheral edges of the wrapping paper layer being adhered to the inner surface of the box blank.

2. A box blank as claimed in claim 1 and further comprising self-adhesive strips applied to said inside surface adjacent to the outermost peripheral edge of each end flap and the mid portion of one of the outer panels.

3. A box comprising a central panel having a center portion and opposed perpendicular end flaps which taper as they extend away from said central panel; opposed side panels joined to the center portion and disposed perpendicularly to said center portion, the side panels having inner portions extending between the end flaps and interlocking end portions with a combined length greater than the distance between said side panels and located inside the end flaps; and opposed outer panels joined to the side panels and having mid portions overlying the center portion in overlapping relationship to close the box, the outer panels further having opposed perpendicular distal flaps overlapping the respective end flaps, said distal flaps tapering as they extend away from said outer panels.

4. A box as claimed in claim 3 wherein the width of one of said outer panels is equal to one-half the width of the central panel and the width of the other of said outer panels is greater than one-half the width of the central panel.

5. A box as claimed in claim 4 wherein the width of the side panel inner portions is equal to the width of the side panel end portions.

6. A box as claimed in claim 5 wherein the width of the end flaps is equal to the width of the side panel inner portions.

7. A box as claimed in claim 6 wherein the box is formed from a planar blank, and wherein the box blank has inner and outer surfaces, and further comprising a layer of wrapping paper located over said outer surface and wrapped around the peripheral edges of the box blank, the peripheral edges of the wrapping paper layer being adhered to the inner surface of the box blank.

8. A box as claimed in claim 3 wherein the end flaps are releaseably attached to the distal flaps.

9. A box as claimed in claim 5 wherein the end flaps are releaseably attached to the distal flaps.

10. A box as claimed in claim 3 wherein the end flaps and distal flaps have side edges disposed at acute angles relative to the side panels.

11. A box as claimed in claim 7 wherein the end flaps and distal flaps have side edges disposed at acute angles relative to the side panels.

12. A box blank comprising:

a central panel having a center portion and opposed end flaps joined thereto along and tapering as they extend away from respective first crease lines;

opposed side panels joined to said central panel along respective second crease lines located perpendicularly to the first crease lines, each side panel having an inner portion and opposed end portions joined to the inner portion along extensions of said first crease lines, said end portions having means for interlocking engagement with a respective adjacent one of said end portions when the side panels are folded perpendicularly to the central panel, the adjacent end portions having a combined length in a direction perpendicular to said first crease line which is greater than the width of said central panel; and opposed outer panels joined to the side panels along respective crease lines located parallel to the second crease lines, each outer panel having a mid-portion and opposed distal flaps joined to said mid-portion along and tapering as they extend away from extensions of the first crease lines, the width of said outer panels combined being greater than the width of the central panel so that the outer panels overlap and a pair of distal flaps overlap an end flap when the box is assembled.

13. A box blank comprising:

a central panel having a center portion and opposed end flaps joined thereto along respective first crease lines, the widths of said end flaps perpendicular to said first crease lines being equal to a first distance;

opposed side panels joined to said central panel along respective second crease lines located perpendicularly to the first crease lines, each side panel having an inner portion and opposed end portions joined to the inner portion along extensions of said first crease lines, said end portions having means for interlocking engagement with a respective adjacent one of said end portions when the portions when the side panels are folded perpendicular to the central panel, the adjacent end portions having a combined length in a direction perpendicular to said first crease line which is greater than the width of said central panel; and opposed outer panels joined to the side panels along respective crease lines parallel to the second crease lines, each outer panel having a mid-portion and opposed distal flaps joined to the said mid-portion along extensions of the first crease lines, the width of said distal flaps perpendicular to said first crease lines being equal to a second distance, the sum of said first and second distances being greater than the width of one of said side panels the width of said outer panels combined being greater than the width of the central panel, and the width of said end flaps being equal to the width of said distal flaps.

14. The box blank of claim 13 wherein said means for interlocking engagement comprise a transverse slot on each of said adjacent portions positioned to allow interlocking engagement between the adjacent end portions.

15. The box blank of claim 13, wherein said means for interlocking engagement comprise a transverse slot on each of said adjacent end portions positioned to allow interlocking engagement between the adjacent end portions.

16. A box blank as claimed in claim 15 wherein the width of the side panel inner portions is equal to the width of the end flaps and the distal flaps.

17. A box blank as claimed in claim 16 wherein the width of said end portions is equal to the width of the side panel inner portions.

18. A box blank as claimed in claim 17 wherein the interlocking means are transverse slots located in the end portions spaced from the first crease lines a distance equal to one-half the width of the central panel.

19. A box blank as claimed in claim 14 wherein the width of the other of said outer panels is greater than one-half the width of the central panel.

20. A box blank as claimed in claim 19 wherein the width of the end flaps is equal to the width of the side panel inner portions.

21. A box blank as claimed in claim 20 wherein the box blank has inner and outer surfaces, and further comprising a layer of wrapping paper located over said outer surface and wrapped around the peripheral edges of the box blank, the peripheral edges of the wrapping paper layer being adhered to the inner surface of the box blank.

22. A box blank as claimed in claim 21 wherein the end flaps and distal flaps have side edges adjacent to the side panels, said side edges intersecting the side panels at acute angles.

23. A box blank as claimed in claim 20 wherein the end flaps and distal flaps have side edges adjacent to the side panels, said side edges intersecting the side panels at acute angles.

24. A box blank as claimed in claim 14 wherein the box blank has inner and outer surfaces, and further comprising self-adhesive strips applied to said inside surface adjacent to the outermost peripheral edge of each end flap and the mid portion of one of the outer panels.

* * * * *